US010433404B2

(12) United States Patent
Jonsson et al.

(10) Patent No.: US 10,433,404 B2
(45) Date of Patent: Oct. 1, 2019

(54) SECURE NETWORK COMMISSIONING FOR LIGHTING SYSTEMS

(71) Applicant: ZUMTOBEL LIGHTING INC, Highland, NY (US)

(72) Inventors: Karl Jonsson, Rancho Santa Margarita, CA (US); Jeffrey Zehler, El Dorado Hills, CA (US)

(73) Assignee: ZUMTOBEL LIGHTING INC., Highland, NY (US)

( * ) Notice: Subject to any disclaimer, the term of this patent is extended or adjusted under 35 U.S.C. 154(b) by 0 days.

(21) Appl. No.: 16/072,566

(22) PCT Filed: Feb. 1, 2017

(86) PCT No.: PCT/IB2017/050522
§ 371 (c)(1),
(2) Date: Jul. 25, 2018

(87) PCT Pub. No.: WO2017/141127
PCT Pub. Date: Aug. 24, 2017

(65) Prior Publication Data

US 2019/0045604 A1 Feb. 7, 2019

Related U.S. Application Data

(60) Provisional application No. 62/295,836, filed on Feb. 16, 2016.

(51) Int. Cl.
*H05B 37/02* (2006.01)

(52) U.S. Cl.
CPC ..... *H05B 37/0272* (2013.01)

(58) Field of Classification Search
CPC ..... H05B 37/0272; H05B 37/02
(Continued)

(56) References Cited

U.S. PATENT DOCUMENTS 8,996,733 B2 * 3/2015 Zueger ..... G06F 3/00 315/152
10,098,207 B2 * 10/2018 Mokhtari ..... H05B 37/0272
(Continued)

FOREIGN PATENT DOCUMENTS

DE 102008056164 2/2010
DE 102014102678 12/2014
(Continued)

OTHER PUBLICATIONS

PCT International Search Report and Written Opinion dated Apr. 21, 2017 in parent PCT Application PCT/IB2017/050522.
(Continued)

*Primary Examiner* — Daniel D Chang
(74) *Attorney, Agent, or Firm* — Andrus Intellectual Property Law

(57) ABSTRACT

A lighting system comprises at least one network-capable infrastructure device and a commissioning device. The infrastructure device, such as a ballast or a luminaire, includes a first communication unit configured to communicate with at least one other infrastructure device, and a second communication unit. The commissioning device comprises a commissioning communication unit configured to communicate with the second communication unit of the infrastructure device. The infrastructure device receives a key information via the second communication unit and communicates via the first communication unit with the at least one other infrastructure device using the received key information.

6 Claims, 5 Drawing Sheets

(58) Field of Classification Search
USPC ..... 315/291, 153
See application file for complete search history.

(56) References Cited

U.S. PATENT DOCUMENTS

| | | | |
|---|---|---|---|
| 2009/0224906 | A1 | 9/2009 | Balgard et al. |
| 2011/0113475 | A1* | 5/2011 | Garcia Morchon .. H04L 12/282 726/4 |
| 2013/0173811 | A1 | 7/2013 | Ha et al. |
| 2013/0223279 | A1 | 8/2013 | Tinnakomsrisuphap et al. |
| 2014/0254577 | A1 | 9/2014 | Wright et al. |
| 2015/0146706 | A1 | 5/2015 | Goluboff |
| 2015/0173154 | A1 | 6/2015 | Faulkner |
| 2015/0366035 | A1 | 12/2015 | Baek et al. |
| 2016/0037614 | A1 | 2/2016 | Setomoto et al. |
| 2016/0095193 | A1 | 3/2016 | Mokhtari et al. |
| 2016/0134603 | A1 | 5/2016 | Cregg |

FOREIGN PATENT DOCUMENTS

| | | |
|---|---|---|
| WO | 2009031112 | 3/2009 |
| WO | 2011045576 | 4/2011 |
| WO | 2011110603 | 9/2011 |
| WO | 2013158653 | 10/2013 |

OTHER PUBLICATIONS

GB Search Report dated May 3, 2017 in co-pending GB Patent Application GB1618548.0.

* cited by examiner

SECURE NETWORK COMMISSIONING FOR LIGHTING SYSTEMS

CROSS REFERENCE TO RELATED APPLICATIONS

The present application is the U.S. national stage application of International Application PCT/IB2017/050522 filed Feb. 1, 2017, which international application was published on Aug. 24, 2017 as International Publication WO 2017/141127 A1. The International Application claims priority to U.S. Provisional Patent Application 62/295,836 filed Feb. 16, 2016.

FIELD OF THE INVENTION

The invention is directed to a lightings system and a commissioning device. For commissioning the lighting system according to the invention key information for secure communication between devices of the lighting system is provided to the individual infrastructure devices. The invention further regards such a network-capable infrastructure device for use in the lighting system, a method for commissioning a secure lighting network, a commissioning device and a network for commissioning a network-capable infrastructure device.

BACKGROUND OF THE INVENTION

Temporary lighting systems, particularly in buildings, can include a large number of elementary units such as lighting units, lighting control units, switches, dimming units, sensor units such as occupancy sensors, ballasts for driving lighting units, communication units such as interfaces to other building systems like HVAC, fire alarm. Often the individual units are furnished with a communication capability and require extensive configuration in order to put the physically installed lighting system into service. The process of commissioning the lighting system may include basic tasks of identifying an installed device, determining a location of the identified device and providing a network address to the identified device. If the lighting system, which stands as an example for other building infrastructure systems, includes a large number of infrastructure devices as its elements, the process of commissioning is cumbersome, requires time and involves significant resources.

The process of commissioning becomes even more complex if the lighting system requires secure communication between its infrastructure devices. The commissioning process then requires to provide key information for a secure exchange of information between the devices constituting the lighting system. The key information is a short piece of information which serves to encode/decode or authenticate a message between one or more infrastructure devices, for example to confirm that a message comes from the stated sender (authenticity) as well as that its message content has not been changed during transit (integrity). However, during commissioning of the lighting system the distribution of key information itself has to be managed such that the key information is not to be intercepted or manipulated.

Several wireless or wired networking stacks allow performing a secure commissioning process. As an example, the Thread network protocol is an internet protocol based (IPv6-) protocol for smart infrastructure devices to communicate over a network. Other examples of such protocols include ZigBee and Bluetooth Smart.

The Thread network protocol is based on an IEEE Standard 802.15.4 wireless protocol with a mesh communication structure and employs 6LoWPAN. 6LoWPAN is an acronym of IPv6 over Low Power Wireless Personal Area Networks. 6LoWPAN defines encapsulation and header compression mechanisms that allow IPv6 packets to be sent and received over IEEE 802.15.4 based networks.

Thread in particular may support a number of devices ranging up to 250 in an IP-addressable network with cloud access and employs AES encryption (Advanced Encryption Standard).

Document "Thread Commissioning", edition 2.0, Jul. 13, 2015, published by the Thread Group Inc. as a technical white paper discloses under the term "commissioning" a process in which a user adds a new device onto a thread network. The disclosed mechanism allows the device joining the network to announce its existence to and in the already existing thread network. A subset of incoming commands is admitted for the joining device in a non-secure network, whereby a full bi-directional communication capability for participation with functionality in the thread network requires secure confirmation of a user.

However the existing commissioning process suffers from only supporting a limited device number of devices in a secure network. The commissioning process basing on the existing solutions is not feasible for secure commissioning of a lighting network comprising hundreds of infrastructure devices in a single building.

Even more severe exchange of information and in particular of key information is performed over the same communication network as the communication to be encrypted. Thus the risk of the key information being subject to eavesdropping and therefore compromising the subsequent allegedly secure communication becomes real.

SUMMARY OF THE INVENTION

The invention addresses the technical problem of commissioning a large number of infrastructure devices in a lighting system into a secure lighting network in an efficient manner avoiding the disadvantages of the current solution.

The problem is solved by the lighting system, the infrastructure device and the commissioning device described herein, as well as the method for commissioning secure lighting network and the method for commissioning a network-capable infrastructure device described herein.

A lighting system comprises at least one network-capable infrastructure device and a commissioning device. The infrastructure device, for example a ballast, includes a first communication unit which performs communication with at least one other infrastructure device, and a second communication unit. The commissioning device includes a commissioning communication unit which is configured to communicate with the second communication unit of the infrastructure device. The infrastructure device is configured to receive a key information via the second communication unit, and to communicate via the first communication unit with the at least one other infrastructure device using the received key information.

By transferring the key information via the second communication unit and the commissioning communication unit, and performing the communication between the infrastructure devices via the first communication unit of the infrastructure devices, distinct communication links, in particular physically distinct communication interfaces for key transfer on one hand and secure communication on the other hand become possible. Intercepting the key information during transfer becomes improbable and thus secure key transfer during commissioning and secure communication in the lighting system afterwards is possible.

Preferably, the lighting system comprises the infrastructure device being configured to receive the key information in a commissioning process of the infrastructure device, wherein the key information is a private key of the infrastructure device.

The lighting system according to an embodiment includes the second communication unit configured to communicate by at least one of visual light communication and acoustic communication, and the first communication unit being configured to communicate by a physically different communication interface than the second communication unit, in particular by a wireless communication interface.

When the first communication unit communicates via wireless communication and the second communication unit employs communication by light and/or acoustic communication the interception probability for the key information is further reduced. Visual communication links such as a VLC communication link (Visible Light Communication) offer the advantage of a reduced and clearly restricted coverage area.

According to an embodiment, the lighting system comprises the infrastructure device which is a ballast device for driving a lighting unit, and the commissioning device is a mobile device or a commissioning application running on a mobile computing device.

Preferably the lighting system comprises the at least one other infrastructure device which is a ballast device for driving a lighting unit, a sensor device, a control device or a luminaire.

The technical problem is also solved by a network-capable infrastructure device, the network-capable infrastructure device including a first communication unit which is configured to communicate with at least one other infrastructure device, and a second communication unit which is configured to communicate with a commissioning device. The infrastructure device is configured to receive key information by the second communication unit, and to communicate with the at least one other infrastructure device via the first communication unit using received key information.

Preferably, the network-capable infrastructure device includes the second communication unit configured to communicate by at least one of visual light communication and acoustic communication, and the first communication unit configured to communicate by a physically different communication interface than the second communication unit, in particular a wireless communication interface.

The network-capable infrastructure device may be a ballast device for driving a lighting unit.

The technical problem is further solved by a method for commissioning a secure lighting network of at least one network-capable infrastructure device, the network-capable infrastructure device comprises a first and a second communication unit. The method comprises steps of a commissioning device transmitting via a commissioning communication unit key information to the network-capable infrastructure device. The infrastructure device receives by the second communication unit such key information and communicates via the first communication unit with at least one other network-capable infrastructure device using the received key information.

According to an advantageous embodiment, the method includes the key information which is a private key of the infrastructure device.

Preferably in the method according to an embodiment, the first communication unit communicates by a physically different communication interface as the second communication unit, in particular by a wireless communication interface, and the second communication unit communicates by at least one of visual light communication and acoustic communication.

A commissioning device for commissioning a network-capable infrastructure device such as a ballast solves the technical problem. The commissioning device includes a commissioning communication unit configured to communicate with a second communication unit of the infrastructure device, a display unit configured to display one or more icons representing the infrastructure devices, and an input unit configured to accept a an input operation to select the displayed infrastructure devices. The commissioning device is configured to transmit a command to the infrastructure device when accepting the input operation, wherein the command makes the infrastructure device to emit a visual or acoustical signal, and to transmit a key information automatically to the infrastructure device when the input unit receives a respective input operation.

The technical problem is solved by a method for commissioning at least one network-capable infrastructure device using a commissioning device. The method comprises a step of displaying an icon representing the at least one infrastructure device on a display unit of the commissioning device, a step of selecting the displayed infrastructure device, a step of transmitting by a commissioning communication unit of the commissioning device automatically in response to the selection operation a command to the infrastructure device to identify itself visually or acoustically when receiving the first input, a step of the commissioning communication unit transmitting key information to the selected infrastructure device when receiving a respective input operation.

By the claimed lighting system, a commissioner can easily browse through the detected and identified infrastructure devices. The identified infrastructure devices, which are yet insecure "grey-listed" infrastructure devices, announce their presence via an intermittent identification signal, such as an indicator light, changing the light intensity, emitting a short sound signal. As the commands are one-way output signals, there is no significant time lag and a user may browse through hundreds of devices in a short amount of time and identify the infrastructure devices of specific interest, for example at a current location of the commissioning user. Once the infrastructure devices have been identified, the user may for example visually drag and drop an icon representing the infrastructure device of interest into a secure commissioning area. The infrastructure device, whose device representation (icon) has been shifted into the secure commissioning area, will now be automatically commissioned by the application in the background and without further requiring an action by the user. For example, the key information is transferred to the joining infrastructure device for enabling secure communication with the lighting system. The feature of tying the automated and secure commissioning process with visually or acoustically perceivable cues provides an efficient solution to the technical problem. The commissioner is not required to register a large number of infrastructure devices manually to allow the infrastructure devices onto the secure lighting network before starting the commissioning process. A risk of an error due to a bulk import of unique device identifiers is also reduced. The installation time for the lighting system is advantageously reduced.

Preferably, the method shows the display unit which indicates the displayed icon as a trusted infrastructure device when having successfully transmitted the key information to the infrastructure device.

According to an advantageous embodiment, the infrastructure device includes a first communication unit for communicating with at least one other infrastructure device and a second communication unit. The second communication unit is configured to communicate with the commissioning communication unit. The infrastructure device is configured to receive the key information via the second communication unit, and to communicate via the first communication unit with the other infrastructure device using the received key information.

The method according to a preferred embodiment comprises the first communication unit being configured to receive the command.

Advantageously, the key information is a private key of the infrastructure device, and the infrastructure device receives the key information in a commissioning process of the infrastructure device.

The method according to a further advantageous embodiment, comprises the first communication unit communicating by a physically different communication interface than the second communication unit, in particular a wireless communication interface, and the second communication unit communicating by at least one of visual light communication and acoustic communication.

The invention will be described in more detail with reference to the attached drawings.

DETAILED DESCRIPTION

Figure 1:
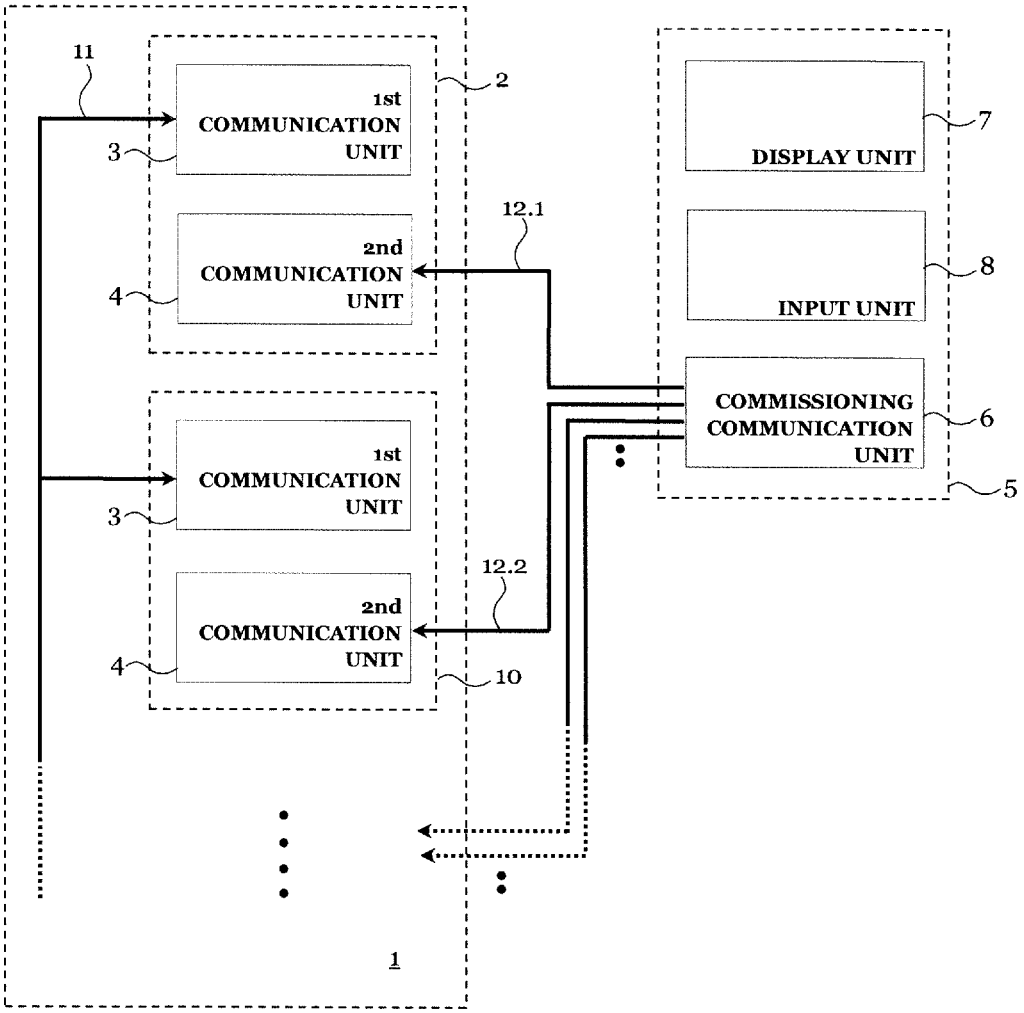
FIG. 1 shows an overview of a lighting system and a commissioning device of an embodiment, FIG. 2 provides a block diagram of a network-capable infrastructure device according to an embodiment.

FIG. 1 shows an overview of a lighting system 1 and a commissioning device 5 of an embodiment of the invention.

In FIG. 1 a lighting system 1 according to an embodiment is shown in a simplified manner which regards in particular the communication means and the interaction of the respective communication means. The depicted infrastructure device 2 and the depicted other infrastructure device 10 represent individual elements of the lighting system 1, which is of course not limited to including only two infrastructure devices 2, 10. The lighting system 1 can comprise a large number of infrastructure devices 2, 10.

An infrastructure device 2 and the other infrastructure device 10 is for example a luminaire, a lighting device, a ballast device for driving light emitting means, an input means such as an On/Off switch, a dimming switch, any sensor such as a presence sensor, a fire alarm, any control means such as a central light control server or the like.

The infrastructure device 2 and the other infrastructure device 10 each include a first communication unit 3 and a second communication unit 4. Further aspects of the infrastructure device 2 beyond the first communication unit 3 and second communication unit 4 will be discussed with reference to FIG. 2 below.

The first communication unit 3 enables the infrastructure device 2 to communicate with at least one other infrastructure devices, 10 of the lighting system 1. The first communication unit 3 is preferably a wireless communication unit which is configured to operate based on at least one communication standard suitable for a home automation network such as Bluetooth, Bluetooth LE, Bluetooth Smart, ZigBee, xAP, DSI, DALI, . . . .

The second communication unit 4 is a communication unit which enables communication according to another communication standard than the first communication unit 3. Particularly the second communication unit 4 is configured to enable communication with a communication counterpart such as a commissioning device 5 via a physically different communication channel or a physically different communication medium than the first communication unit 1. The second communication unit preferably communicates by means of optical signals or acoustical signals. The second communication unit 4 of a preferred embodiment uses visible light communication (VLC) for communication.

In FIG. 1 the second communication unit 4 is shown to receive second communication signals 12.1, 12.2 only. However the second communication unit 4 can be adapted to transmit and to receive communication signals 12.1, 12.2.

In FIG. 1 a commissioning device 5 is shown. The depicted commissioning device 5 includes a commissioning communication unit 6, a display unit 7 and an input unit 8.

The commissioning communication unit 6 is configured to communicate according to another communication standard than the first communication unit 3 of the infrastructure device 2. Particularly the commissioning communication unit 6 is configured to enable communication with the second communication unit 4 of an infrastructure device 2 as communication counterpart via a physically different communication channel or a physically different communication medium than the first communication unit 3. The commissioning communication unit 6 preferably communicates by means of optical signals or acoustical signals. In a preferred embodiment, the commissioning communication unit 6 is adapted to use VLC. In FIG. 1 the commissioning communication unit 6 is shown to transmit second communication signals 12.1, 12.2 only. However the second communication unit 4 can be adapted to transmit and to receive communication signals 12.1, 12.2, thus working in a bidirectional manner.

The display unit 7 of the commissioning device 5 may be the display of a mobile computing unit. The display unit 7 may also integrate the function of the input unit 8 when being implemented by the touch sensitive display of a mobile computing device. The commissioning device 5 is advantageously a mobile computing device, a smart phone or a tablet computer with a particular commissioning software program running on a processing unit the mobile computing device. The commissioning software program is adapted to implement the functionalities required for commissioning the lighting system 1.

Figure 2:
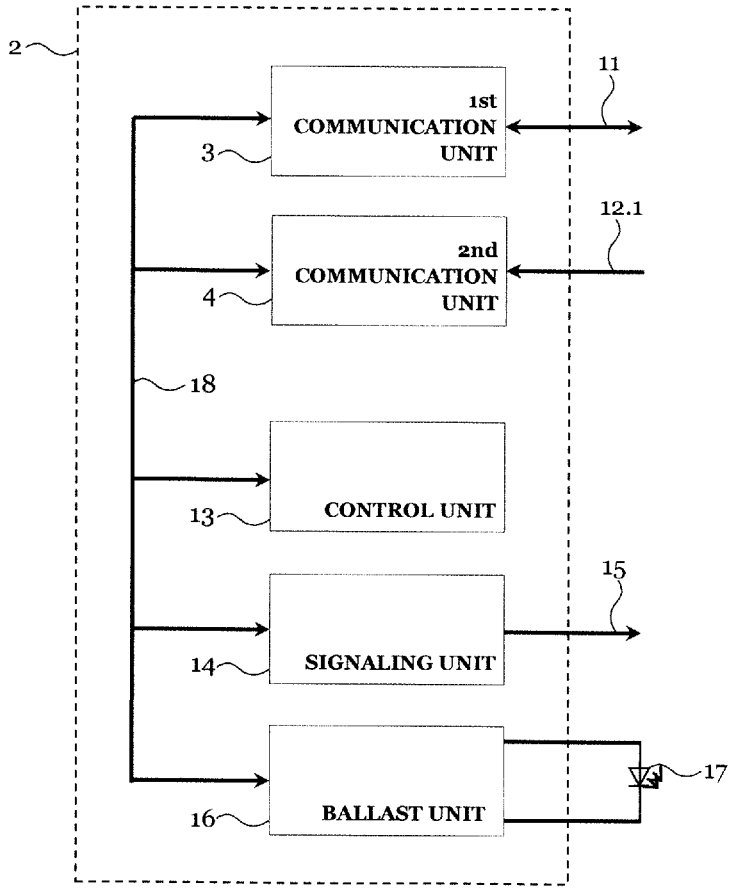

FIG. 2 shows a block diagram of a network-capable infrastructure device 2 according to an embodiment.

The network capable infrastructure device 2 is adapted to operate in lighting system 1. For communicating by communication signals 11 with at least one other infrastructure device 10 in lighting system 1 (lighting network), the infrastructure device 2 comprises the first communication unit 3 which is already discussed above with reference to FIG. 1. The network capable infrastructure device 2 includes further the second communication unit 4 which performs communication using a different communication standard than the first communication unit 3.

The infrastructure device 2 of a preferred embodiment further includes a signaling unit 14. The signaling unit 14 is adapted to emit an acoustically or optically perceivable signal 15. The signaling unit 14 of an embodiment controls a status LED of the infrastructure device 2 to emit a signal 15 in the shape of a light signal, for example an intermittent light signal or light flash.

The signaling unit 14 of an embodiment emits a signal 15 as an identification signal unambiguously identifying the infrastructure device 2, for example be emitting a signal 15 carrying a modulated identification information of the infrastructure device 2.

The signaling unit 14 of an embodiment controls a buzzer or beeper to emit an acoustic signal, for example a short beep.

The signaling unit 14 according to an embodiment controls a ballast unit 16 of the infrastructure device 2 to change a light intensity of a light emitting unit 17 to vary at least one light parameter of emitted light, for example a light intensity or a light color, in a distinguishable manner.

The exemplary infrastructure device 2 shown in FIG. 2 is a ballast for driving lighting devices 17. The infrastructure device 2 includes a ballast unit 16 which provides a driving signal for driving the at least one light emitting unit 17. The at least one light emitting unit 17 preferably includes one or more light emitting diodes (LED, OLED) or gas discharge lamps for emitting light.

The first communication unit 3, the second communication unit 4, the signalling unit 14 and the ballast unit 16 a connected via internal communication means, for example an internal bus system 18. The internal bus system 18 connects a control unit 13 of the infrastructure device 2 with the other units of the infrastructure device 2. The control unit 12 performs controlling of an operation of the infrastructure device 2, the operation including the standard function of driving the light emitting unit 17 as well as the process of commissioning the infrastructure device 2.

In particular the control unit 13 may be implemented in form of a microcontroller which performs the method steps for performing commissioning of the infrastructure device 2 according to the invention.

Furthermore, the control unit 13 can be adapted to control at least one of the first communication unit 3 and the second communication unit 4 to transmit at least for predetermined time an identification signal. The identification signal is adapted to unambiguously identify the infrastructure device 2. The identification signal can be transmitted in response to a received request, regularly for a time interval at the predetermined time or even continuously.

Figure 3:
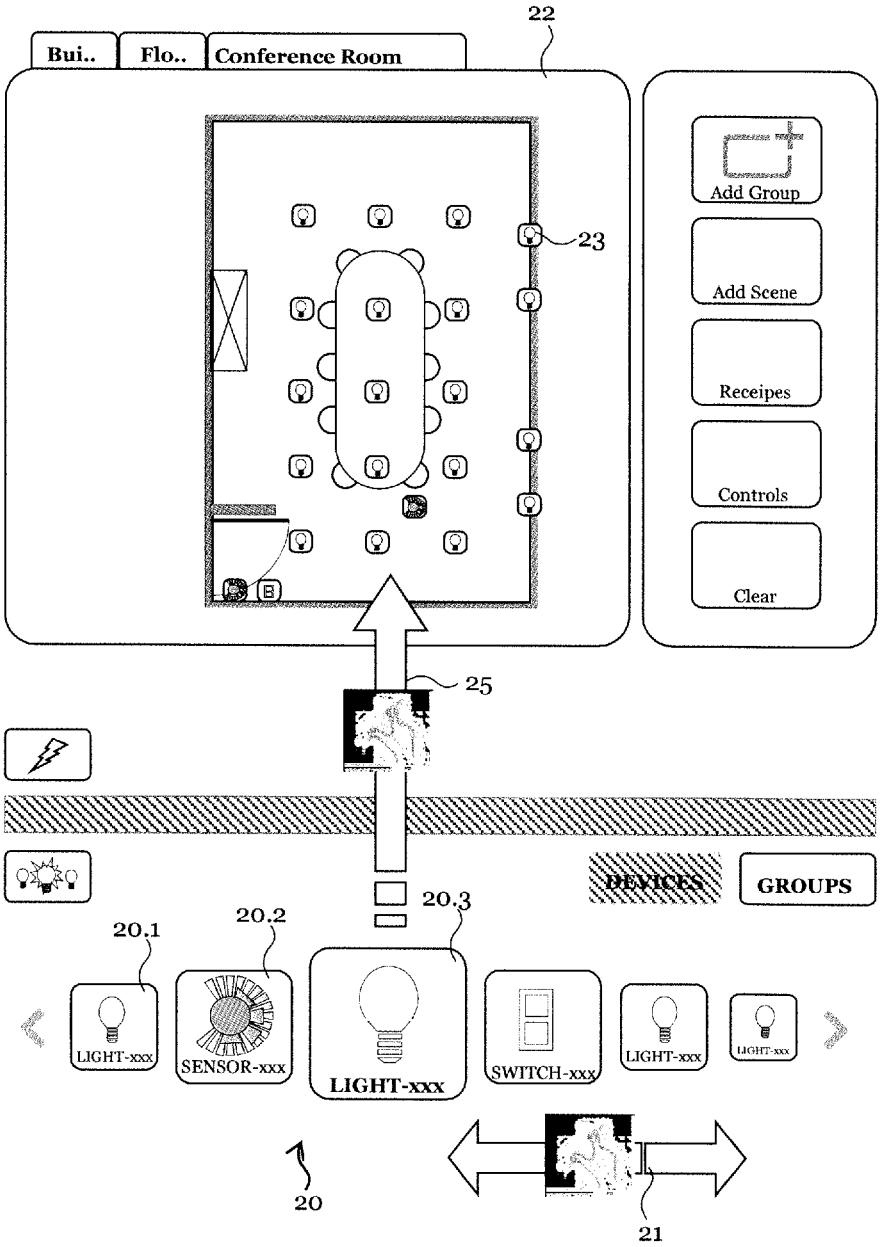
FIG. 3 shows an exemplary screen display of user interface of a method for commissioning a secure lighting system according to an embodiment, FIG. 4 provides a flowchart of a method for commissioning a network-capable infrastructure device according to an embodiment.

FIG. 3 shows an example for a screen display of a user interface of a method for commissioning a secure lighting system 1 according to an embodiment.

A commissioning method according to an embodiment of the invention is advantageously performed using an application software program running on a processor of an electronic device, for example a mobile computing device. The computing device further includes internally or externally connected at least the commissioning communication unit 6.

The screen display on display unit 7 is divided in multiple display areas. A first display area 20 displays a number of icons 20.1, 20.2, each icon representing a detected infrastructure device 2. For example, the first icon 20.1 represents a detected luminaire, the second icon 20.2 represents a detected presence sensor. A user may use the touch sensitive display unit to browse through the detected icons 20.1, 20.2 by a first input operation 21.

The icons 20.1, 20.2 which can be displayed in the first area 20 each represent a detected infrastructure device 2, however a key information is not yet shared with the corresponding infrastructure devices 2. The infrastructure devices 2 represented in the first area 20 are thus not trusted devices as secure communication with them via the respective first communication means 3 is not yet possible. As the infrastructure devices 2 share no key information with the lighting network, they are thus only allowed restricted device functionalities in the lighting system 1. In particular, the infrastructure devices 2 represented in the first area 20 are thus denied any authority towards the lighting network. The infrastructure devices 2 represented in the first area 20 may be considered as being blind to the lighting network.

The user browses through the icons 20.1, 20.3, 20.3 using a first operation input 21 shifting the icons 20.1, 20.3, 20.3 in a horizontal direction. When, for example, placing the icon 20.3 at the centermost position in the first area 20, the corresponding infrastructure device 2 is controlled to emit a visually or acoustically perceivable signal. Thus a user is enabled to identify the corresponding infrastructure device 2 out of a plurality of infrastructure devices 2 positioned within the user's view.

The user can select an icon 20.1, 20.2, 20.3 with a second input 25 and move the icon 20.1, 20.2, 20.3 from the first area 20 into a second area 22 on the displayed screen.

The first input 21 and the second input 25 can be a "drag and drop" type operation performed on the touch-sensitive display of the display unit 7 of the commissioning device 5.

In FIG. 3 the second input 25 is performed on icon 20.3 on the centermost position in the first area 20. By selecting icon 20.3 and shifting it to the second area 22, infrastructure device 2 corresponding to the icon 20.3 is selected to be subject to a commissioning process. The commissioning process will be run advantageously in the background of the commissioning software program. The commissioning process running in the background of the commissioning software program includes providing the key information to the infrastructure device 2 via the communication signal 11.1, 11.2 between the commissioning communication unit 6 and the second communication unit 4.

When the commissioning process has been successfully finished, the infrastructure device 2 shares the key information with the lighting system 1. Thus the infrastructure device 2 is a confirmed and now a trusted resource in the lighting system 1 and may perform its assigned functions to a full extent.

The commissioning process as discussed with reference to FIG. 3 enables a user to control commissioning in comfortable and effective manner by browsing with a first input 21 through infrastructure devices 2 represented in the first area 20. The infrastructure devices 2 in the first area 20 may be termed grey-listed infrastructure devices 2, as only restricted functionalities are allowed for the infrastructure devices 2 represented in the first area 20. The infrastructure devices 2 in the second area 22 may be termed white-listed infrastructure devices 2, as full and unrestricted functionalities are allowed for the infrastructure devices 2 represented in the second area 22.

Figure 4:
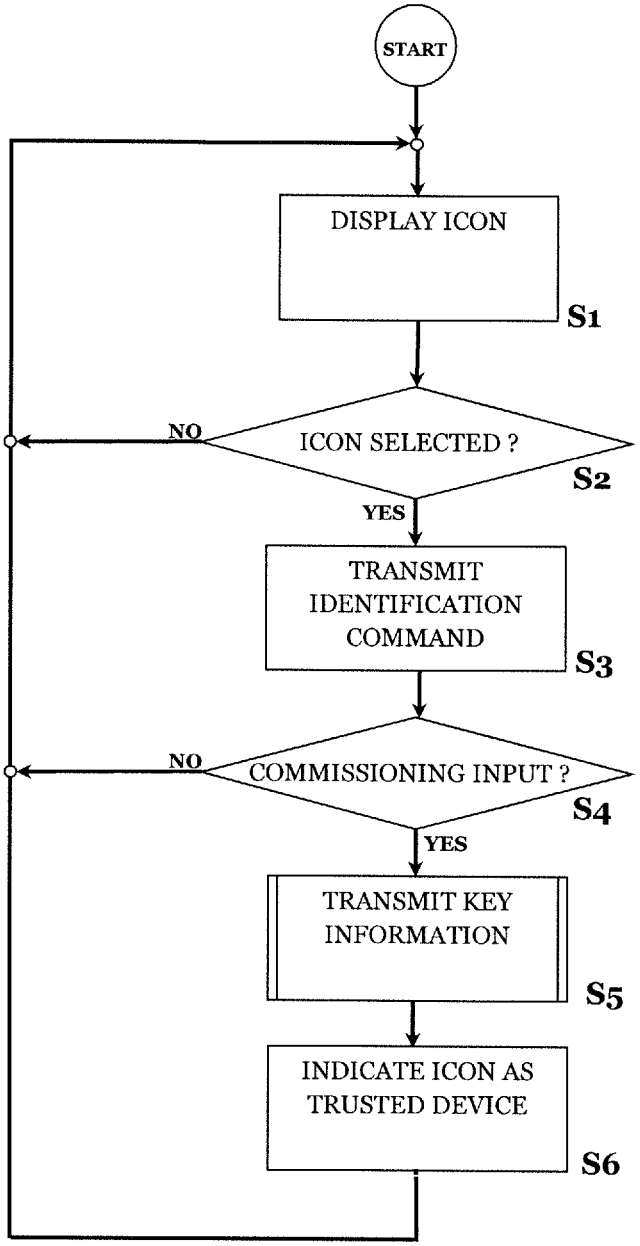

FIG. 4 provides a flowchart of a method for commissioning a network-capable infrastructure device 2 according to an embodiment.

The method for commissioning at least one network-capable infrastructure device 2 using a commissioning device 5 starts with a step of displaying an icon 20.1, 20.2, 20.3 representing the at least one infrastructure device 2 on a display unit 7 of the commissioning device 5.

In succeeding step S2 the displayed infrastructure device 2 is selected with a first input 21. After selecting the infrastructure device 2 in the step S2, the method proceeds to step S3. In step S3, the commissioning communication unit 6 of the commissioning device 5 automatically and in response to the selection operation transmits a command to the infrastructure device 2 to identify itself visually or acoustically In step S4 succeeding to the step S3 it is determined, if a second input 25 is performed by the input unit 8. If the input unit 8 determines a respective second input 25 with respect to the infrastructure device 2, the method proceeds to step S5.

In step S5 the commissioning communication unit 6 transmits key information to the selected infrastructure device 2 after having receiving a respective second input 25 in step S4.

In step S6 succeeding to the step S5, the display unit 7 proceeds to displaying a screen in which the displayed icon is marked as a trusted infrastructure device 2 due to successfully transmitting the key information to the infrastructure device 2.

If in step S2 no first input 21 to the displayed icon 20.1, 20.2, 20.3 is detected, the method returns to step S1 of displaying an icon 20.1, 20.2, 20.3 without further action.

If in step S4 no second input 25 meaning a commissioning request operation on the displayed icon 20.1, 20.2, 20.3 is detected, the method returns to step S1 of displaying the icon 20.1, 20.2, 20.3 without further action.

Figure 5:
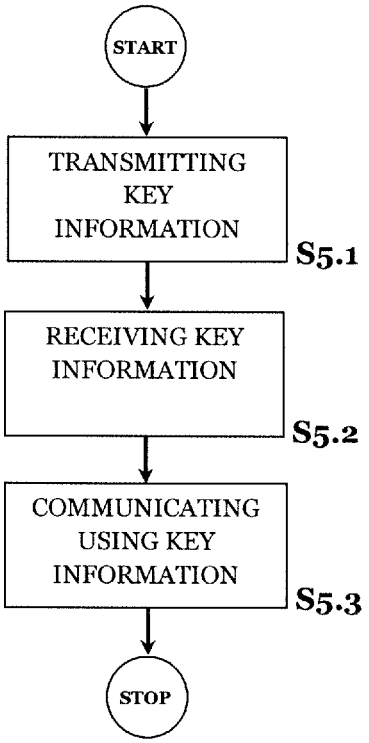
FIG. 5 shows steps of a method for commissioning a network-capable infrastructure device according to an embodiment.

In FIG. 5, the step S5 of transmitting key information in a method for commissioning a network-capable infrastructure device 2 according to an embodiment is shown in more detail.

In a step S5.1, the commissioning device 5 transmits via a commissioning communication unit 6 the key information to the infrastructure device 2. In particular the commissioning communication unit 6 transmits a commissioning signal 12.1, 12.2 comprising the key information to the second communication unit 4 of the infrastructure device to be commissioned.

The infrastructure device 2 receives by the second communication unit 4 the key information in the step S5.2.

After receiving the key information in step S5.2, the infrastructure device 2 communicates via the first communication unit 3 with at least one other infrastructure device 10 and its first communication unit 3 using the key information key information received in the step S5.2.

The invention is discussed with reference to a lighting system 1 and an infrastructure device 2 being a ballast. However, the claimed invention is also applicable for other infrastructure devices forming part of a lighting system 1 or general infrastructure system, such as a fire warning system.

The invention claimed is:

1. A commissioning device for commissioning a network-capable infrastructure device (2) having a first communication unit and a second communication unit that is physically separate from the first communication unit, the second communication unit communicating wirelessly by visual light communication or acoustic communication, the commissioning device including:

a commissioning communication unit (6) configured to communicate with a second communication unit (4) of the infrastructure device (2) by at least one of visual light communication and acoustic communication, a display unit (7) configured to display an icon representing the infrastructure device (2), and an input unit (8) configured to accept an input operation to select the displayed infrastructure device (2), and wherein the commissioning device is configured to transmit a command to the selected infrastructure device (2) through the second communication unit upon accepting the input operation, and the command makes the selected infrastructure device (2) emit a visual or acoustical signal that identifies itself, and wherein the commissioning device is further configured to transmit a key information to the infrastructure device (2) through the second communication unit upon the input unit (8) receiving a second input operation in the form of a commissioning request for the identified infrastructure device through the input unit.

2. The commissioning device according to claim 1, wherein the commissioning device (5) is a mobile device or a commissioning application running on a mobile computing device.

3. A The method according to claim 1, wherein the display unit (7) indicates the displayed icon as a trusted infrastructure device (2) when successfully transmitting the key information to the infrastructure device (2)(S6).

4. A method for commissioning at least one network-capable infrastructure device (2) using a commissioning device (5), the method comprising steps of:

providing at least one network-capable infrastructure device (2) having a first communication unit for communicating with at least one other infrastructure device (10) over a network and a second communication unit that is physically separate from the first communication unit, the second communication unit communicating wirelessly by at least one of visual light communication or acoustic communication;

providing a commissioning communication unit (6) that is configured to communicate with the second communication unit (4) by at least one of visual light communication and acoustic communication;

displaying an icon representing the at least one infrastructure device (2) on a display unit (7) of the commissioning device (5)(S1);

selecting the displayed infrastructure device (2)(S2) by entering a first input into the commissioning device;

transmitting by the commissioning communication unit (6) of the commissioning device (5) automatically in response to the selection operation and entry of the first input, a command to the selected infrastructure device (2) through the second communication unit to identify itself by emitting a visual or acoustic signal upon receiving the command;

receiving the visual or acoustic signal from the second communication unit of the selected infrastructure device that identifies the infrastructure device;

requesting that the identified infrastructure device be commissioned by entering a second input into the commissioning device;

transmitting a key information from the commissioning communication unit (6) of the commissioning device by at least one of visual light communication and acoustic communication to second communication unit of the selected infrastructure device (2) upon entry of the second input into the commissioning device;

receiving the key information in the infrastructure device via the second communication unit (4);

communicating via the first communication unit (3) with the at least one other infrastructure device (10) on the network using the received key information.

5. The method according to claim 4, wherein the display unit (7) indicates the displayed icon as a trusted infrastructure device (2) when successfully transmitting the key information to the infrastructure device (2)(S6).

6. The method according to claim 4, wherein the key information is a private key of the infrastructure device (2), and the infrastructure device (2) is configured to receive the key information in a commissioning process of the infrastructure device (2).

* * * * *